US007743849B2

(12) United States Patent
Kotsonis et al.

(10) Patent No.: US 7,743,849 B2
(45) Date of Patent: Jun. 29, 2010

(54) DUAL TRACTOR DRILLING SYSTEM

(75) Inventors: Spyro Kotsonis, Glos (GB); Eric Lavrut, Yokohama (JP)

(73) Assignee: Schlumberger Technology Corporation, Sugar Land, TX (US)

( * ) Notice: Subject to any disclaimer, the term of this patent is extended or adjusted under 35 U.S.C. 154(b) by 373 days.

(21) Appl. No.: 11/575,179

(22) PCT Filed: Sep. 15, 2005

(86) PCT No.: PCT/EP2005/010069

§ 371 (c)(1),
(2), (4) Date: Mar. 13, 2007

(87) PCT Pub. No.: WO2006/032430

PCT Pub. Date: Mar. 30, 2006

(65) Prior Publication Data

US 2008/0314639 A1 Dec. 25, 2008

(30) Foreign Application Priority Data

Sep. 20, 2004 (EP) ..... 04292251

(51) Int. Cl.
*E21B 4/18* (2006.01)

(52) U.S. Cl. ..... 175/51; 175/95; 175/97

(58) Field of Classification Search ..... 175/51, 175/94, 95, 97
See application file for complete search history.

(56) References Cited

U.S. PATENT DOCUMENTS

| | | | | | |
|---|---|---|---|---|---|
| 3,280,923 | A | * | 10/1966 | Muench | 376/273 |
| 5,752,572 | A | * | 5/1998 | Baiden et al. | 175/26 |
| 6,003,606 | A | * | 12/1999 | Moore et al. | 166/381 |
| 6,082,461 | A | | 7/2000 | Nelson et al. | |
| 6,142,245 | A | * | 11/2000 | Best | 175/57 |
| 6,467,557 | B1 | | 10/2002 | Beaufort et al. | |
| 7,080,700 | B2 | * | 7/2006 | Bloom et al. | 175/51 |
| 7,156,192 | B2 | * | 1/2007 | Guerrero et al. | 175/51 |
| 2001/0045300 | A1 | | 11/2001 | Krueger et al. | |
| 2004/0168828 | A1 | | 9/2004 | Krueger et al. | |

FOREIGN PATENT DOCUMENTS

| | | | | | |
|---|---|---|---|---|---|
| DE | 2733199 | A | * | 2/1979 | 175/51 |
| GB | 2398308 | | | 8/2004 | |

* cited by examiner

*Primary Examiner*—Kenneth Thompson
(74) *Attorney, Agent, or Firm*—Dave R. Hofman

(57) ABSTRACT

The invention provides a drilling system for use in a borehole through an underground formation, comprising:
a drilling assembly including a drill bit for drilling through the formation and a drilling drive;
conveyance means including a conveyance drive connected to the drilling assembly and operable to move the drilling assembly through the borehole,
wherein the conveyance drive is operable to move the drilling assembly along the borehole into a drilling position and the drilling drive is operable to urge the drill bit into contact with the formation when drilling takes place in the drilling position.

9 Claims, 1 Drawing Sheet

DUAL TRACTOR DRILLING SYSTEM

CROSS-REFERENCE TO RELATED APPLICATIONS

This application claims the benefit of PCT/EP2005/010069, filed on Sep. 15, 2005 and having a priority date of Sep. 20, 2004.

BACKGROUND

This invention relates to a system for drilling underground boreholes. In particular the invention relates to such systems in which a drilling tool is moved through the borehole using a tractor or similar device.

In a conventional drilling setup, a drill bit is mounted on a bottom hole assembly (BHA) that is connected to a drill string made up of tubular members connected in an end-to-end arrangement. The BHA can include measuring instruments, a drilling motor, telemetry systems and generators. Penetration is achieved by rotating the drill bit while applying weight on a bit (WOB). Rotation can be achieved by rotating the drill string at the surface or by use of a drilling motor downhole on which the drill bit is mounted. The drilling motor is typically powered by flow of a drilling fluid through the drill string and into a hydraulic motor in the BHA. The drilling fluid exits through the drill bit and returns to the surface outside the drill string carrying drilled cuttings with it. WOB is applied by the use of heavyweight drill pipe in the drill string above the BHA.

Clearly WOB can only be applied when the heavyweight drill pipe is close to the borehole. When it is desired to drill highly deviated borehole sections (close to horizontal), the heavyweight drill pipe may have to be located some distance from the BHA in order for it to be in a borehole section that is close to vertical.

Another form of drilling uses coiled tubing to connect the BHA to the surface. An example of this is found in Hill D, Nerne E, Ehlig-Economides C and Mollinedo M "Reentry Drilling Gives New Life to Aging Fields" Oilfield Review (Autumn 1996) 4-14 which describes the VIPER Coiled Tubing Drilling System. In this case the coiled tubing is used to push the drilling tool along the well and provide WOB. However, problems can occur as the coiled tubing does not have great strength in compression.

Recently, various proposals have been made for drilling systems conveyed on wireline cable. An example of this is found in PCT/EP04/01167. Clearly a flexible cable cannot be used to provide WOB.

The various problems incurred in obtaining WOB, in conventional, coiled tubing and wireline drilling have led to the development of tractor or thruster devices to provide the necessary WOB. These devices typically lock in the borehole above the drill bit to provide a reaction point and use a drive mechanism to urge the drill bit away from the reaction point and provide WOB.

There have been a number of proposals for tractors and thrusters. Tractors are used to convey borehole tools along the borehole in highly deviated situations. These typically pull the tool(s) on a wireline cable down the well which is then logged back up the well on the wireline cable pulled from the surface. Examples of tractors for such uses can be found in U.S. Pat. No. 5,954,131, U.S. Pat. No. 6,179,055 and U.S. Pat. No. 6,629,568. A tractor for use with coiled tubing or drill pipe is described in U.S. Pat. No. 5,794,703.

Rather than pulling the tool, a thruster pushes a tool forward. Examples of such thrusters can be found in U.S. Pat. No. 6,003,606, U.S. Pat. No. 6,230,813, U.S. Pat. No. 6,629,570 and GB 2 388 132. Thrusters often can be used for pulling as well. The term "tractor" is used in this application to indicate both forms of device. Where a distinction is required, the terms "pulling tractor" and "pushing tractor" are used.

There are various mechanisms used by tractors. In one approach, wheels or chains act on the borehole wall to drive the tractor along. Another approach is a push-pull crawler. In this case, the device locks one end against the borehole wall and extends a free end forward. At the limit of its extent, the free end is then locked and the other end released and retracted to the newly locked end. When fully retracted, the other end is locked and the locked end released and advanced again. This is repeated as required to either push or pull equipment connected to the tractor. This can be used for both pushing and pulling actions.

Drilling using a wireline cable from the bottom-hole drilling assembly (BHA) to the surface offers many benefits in terms of reduction of cost to drill, and reduction of assets and personnel. However, with these comes a reduction in the available power available to drill with. This decrease in power creates the need to optimize the drilling process by applying a lower than conventional force and torque at the bit, and also being able to control the rate of penetration (ROP) or advancement in real time. This control by definition requires drilling assemblies that move slowly. With the limited power available downhole from the wireline cable, the drilling speed is typically limited to a few meters per hour. This drilling tool however also needs to trip in and out of the hole for changing the bit or to modify settings. The wireline cable can be used to trip quickly (up to 3000 m/hr) in the vertical section of the well; but a lot of wells today would have an inclination that can even reach horizontal. Wireline tractors of the type described above are used to quickly run the measurement equipment to bottom and log (even at 3000 m/hr) back up the well. These same tractors though are not optimized for very slow and accurate movement as required for the drilling process.

SUMMARY

The present invention aims to provide a drilling system that can be used in highly deviated wells and using a wireline cable as a conveyance but which avoids some or all of the problems associated with the use of tractors and thrusters indicated above.

The invention provides a drilling system for use in a borehole through an underground formation, comprising:

a drilling assembly including a drill bit for drilling through the formation and a drilling drive;

conveyance means including a conveyance drive connected to the drilling assembly and operable to move the drilling assembly through the borehole, wherein the conveyance drive is operable to move the drilling assembly along the borehole into a drilling position and the drilling drive is operable to urge the drill bit into contact with the formation when drilling takes place in the drilling position.

The conveyance and drilling devices each preferably have both pushing and pulling functions.

The drilling drive is operable so as to control the weight applied to the drill bit during drilling. When the drill bit is rotated during drilling, the drilling drive is operated to avoid bit stalling.

The drilling drive can include an anchor mechanism for anchoring at least one end of the drilling drive in position in the borehole. When the drill bit is rotated during drilling, the anchoring system anchors the drilling assembly against rotation arising from torque generated by rotation of the drill bit. The drilling device can be operated to limit the force applied to the drill bit to urge it into contact with the formation during drilling in order to avoid slipping of the anchoring system in the borehole, or to limit the force applied to the drill bit to urge it into contact with the formation during drilling in order to avoid overloading the drilling assembly.

The drilling drive can include a flow conduit to allow drilling fluid to flow through the drilling drive to or from the drill bit. In one embodiment wherein the conduit is connected to a supply of drilling fluid which passes through the conduit and the drill bit and carries drilling cuttings away from the drilling position outside the drilling assembly. In another, the conduit is connected to the drill bit so as to direct a flow of drilling fluid carrying drilling cuttings away from the drilling position inside the drilling assembly.

The conveyance drive, typically a wireline or coiled tubing tractor connected to a wireline cable or coiled tubing extending from the conveyance drive through the borehole to the surface, is operable to move the drilling assembly through the borehole at more than 10 times the rate at which the drilling device is operable to urge the drill bit forward during drilling. The drilling drive typically advances at a rate of a few metres per hour. The conveyance drive typically moves the drilling assembly through the borehole at hundreds of metres per hour.

The conveyance drive is typically operable to move the drilling assembly through portions of the borehole that are highly deviated from vertical. Where the borehole comprises a main borehole and an extension borehole, the conveyance drive being separated from the drilling assembly by sufficient distance that the conveyance drive is located in the main borehole when the drilling assembly is in a drilling position in the extension borehole.

Preferably, the drilling assembly comprises a drilling motor for rotating the drill bit. The drilling device is operable to advance the drilling motor and the drill bit while it is rotated by the drilling motor in order to drill material from the formation. Typically the conveyance motor is inoperable when the drilling drive operates and vice versa.

DETAILED DESCRIPTION

Figure 1:
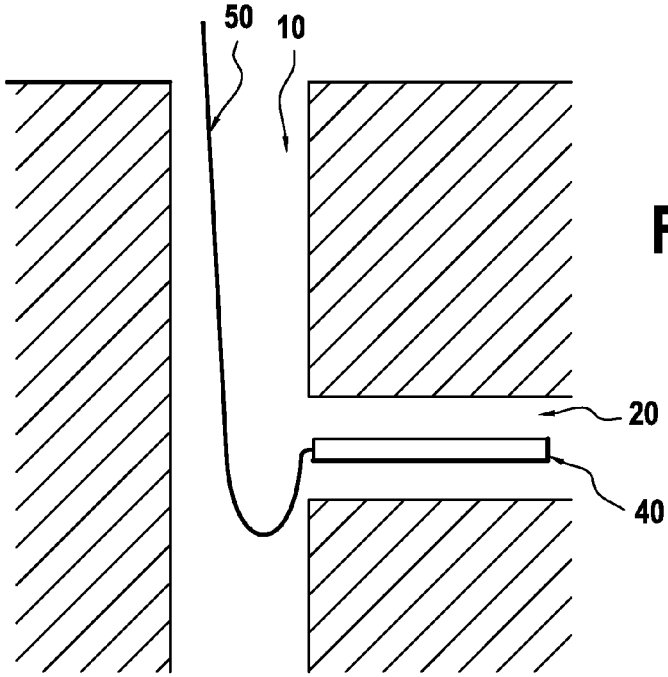
FIG. 1 shows a drilling system according to an embodiment of the invention in a borehole.

FIG. 1 shows a drilling system according to an embodiment of the invention in a borehole such as an oil or gas well. The borehole comprises a main section 10 which is generally vertical and a side branch 20 that extends away from the main section. The side branch 20 is horizontal or close to horizontal. The drilling system comprises a downhole section 40 which is suspended on a wireline cable 50 extending from the surface. The wireline cable 50 provides power and data communication with the downhole section 40 and can be used to raise or lower the downhole section 40 in the vertical main part of the borehole 10.

The downhole section 40 includes a conveyance system and a drilling assembly which are described in more detail below. In the version shown in FIG. 1, both are positioned in the side branch 20. In another version (not shown), the conveyance system and drilling assembly are separated by a length of flexible tubing such that the conveyance system is located in the vertical main section of the borehole 10 while the drilling assembly is in the horizontal side branch 20. In many cases, the main section 10 will be cased while the side branch 20 is uncased (open hole).

Figure 2:
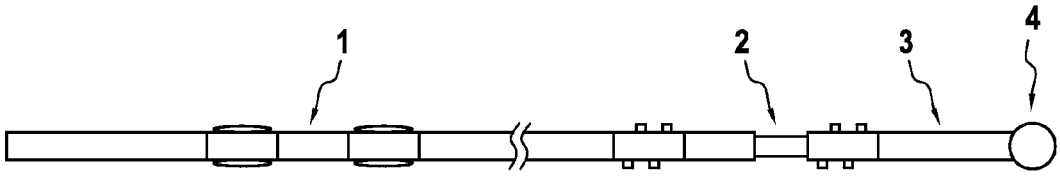
FIG. 2 shows a general view of a drilling system according to an embodiment of the invention.

FIG. 2 shows that the downhole section 40 of FIG. 1 that can be lowered into the borehole on the end of the wireline cable (or coiled tubing).

In the embodiment of the invention shown in FIG. 2, a drill bit 4 is used to drill a borehole for the eventual production of hydrocarbons. The bit is rotated using the electrical drilling motor, powered via the cable 3 that supplies a controlled rate of rotation (RPM) and torque (TOR), to the drill bit. The drilling crawler (drilling drive) 2 advances the drilling motor 3 and in turn the bit 4. The drilling crawler supplies a controlled rate of penetration (ROP) and weight on the bit (WOB) to optimize the drilling process. During the drilling process the tripping tractor (conveyance drive) 1 is passive and is pulled along with the cable as the drilling assembly advances. The tripping tractor 1 can be of the type described in U.S. Pat. No. 5,794,703, U.S. Pat. No. 5,954,131 or U.S. Pat. No. 6,179,055, or any other similar device. The drilling crawler 2 can be of the type described in PCT/EP04/01167.

During the initial trip to move the bottom-hole assembly (BHA) to the bottom of the hole, or when the need arises to trip the assembly back out of the hole, the crawler 2 is deactivated, and the tractor 1 is turned on to travel quickly.

The drilling system shown in the drawings (comprising the downhole section 40 in FIG. 1) includes two tractor devices used in tandem that serve different purposes: one as a conveyance drive (the tripping tractor 1) and the other as a drilling drive (the drilling crawler 2). The drilling drive is a tractor (or crawler) that can precisely control weight on bit and rate of penetration to optimize the drilling process of a drilling tool with limited power, while the conveyance drive is used to quickly run in and out of the hole.

The drilling tractor 2 can act to decouple the drilling advancement stage (low speed with medium force), from the running in/out stage (higher speed with high force). This in turn allows for a smoother operation of the drilling assembly.

During the tripping stages (either in or out, and for 1000's of meters), the crawler 2 is inoperative in order to provide the minimum possible resistance to tripping (anchors or other devices that could come into contact with the borehole or easing/tubing upsets are retracted), while the tripping tractor 1 is operated at full speed to decrease the tripping time. During the drilling stage, the tripping tractor is in turn inoperative in order to consume the minimum (if not zero) amount of power to allow for maximum power at the bit.

The distance between the two tractors is not limited to a Bottom-Hole Assembly (BHA) length, as the tripping tractor can be located in the main wellbore as is described above with the following benefits: easier design as it would not need to crawl in Open Hole, and lower Lost In Hole (LIH) cost in case of open hole collapse or other event.

Figure 3:
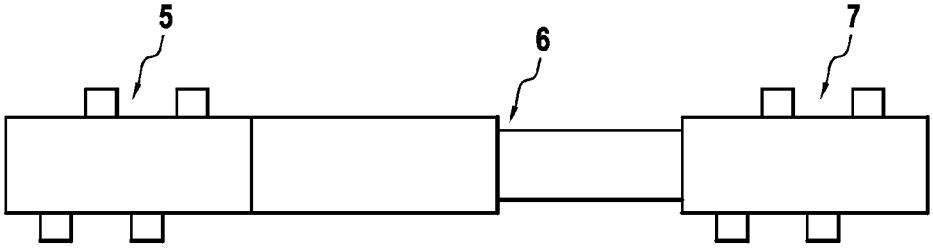
FIG. 3 shows a more detailed view of a drilling device used in the embodiment of FIG. 2.

The difference in the requirements of the tripping tractor 1 and the crawler 2 leads to a significant different in optimum design. The tractor 1 needs to be much faster and so may employ chains or wheels to advance in the borehole (especially to be able to travel in open hole (OH)), whereas the crawler 2 will employ a slower activation mechanism (such as hydraulic pistons) that can be more finely controlled. The crawler shown in FIGS. 2 and 3 is composed of two anchoring mechanisms 5 and 7 and a stroker piston 6. The sequential activation of these components listed below allows the crawler to advance.

With the crawler piston 6 retracted at the bottom of the hole, the upper anchor 5 extends to lock itself in the borehole. The piston 6 is then activated (either hydraulically or mechanically) to extend in a controlled manner to force the bit 4 to drill the formation ahead. The total stroke of the piston is sufficient to allow for any slippage of the anchor 5. In one possible embodiment, the piston stroke is 10 inches. Once the piston has reached the end of its stroke, the lower anchor 7 is activated to lock itself against the borehole wall, then the upper anchor 5 is retracted, and finally the piston 6 is retracted to its shortest-length position. The upper anchor 5 is then extended to lock itself in the borehole and the cycle begins again to drill another full piston stroke.

This same crawler can reverse the activation sequence to pull back at a slow speed if required.

In the proposed embodiment, the drilling ROP of the crawler is in the order of 1-15 m/hr, whereas the maximum achievable speed during upward travel is in the order of 60 m/hr. This crawler employs a plurality of pistons around the anchors 5 and 7 that are hydraulically activated. The tripping tractor 1 in turn uses chains or wheels against the borehole wall to achieve a speed in the 3000 m/hr range, thus significantly decreasing the time spent going in and out of the well. During tripping, the crawler 2 must retract the anchors 5 and 7, and close the piston 6, to create the minimum possible drag, and to negotiate turns (dog legs) better (especially the eventual exit from the parent casing to the open-hole lateral.

An additional advantage and use of the proposed dual-tractor method is that in the event one of the tractors enters an over-gauge hole section (due to wash-out), or enters a very soft formation and can no longer provide traction; the second tractor can be used to push or pull the assembly the required distance to get out of the difficult section. This also decreases the chances of getting a tool-string stuck in the hole, since even in the event of a complete break-down of one of the tractors, the other can get the assembly back to the main wellbore from where they can be pulled to the surface using the wireline cable.

In another embodiment, the tripping tractor can be at a distance sufficient so as to allow the tripping tractor to remain in the main well casing or tubing even as the drilling crawler reaches its target. This would allow for a simpler design of the tripping tractor (since it would not need to travel in open-hole), and would also decrease the Lost-In-Hole cost of the assembly in case of open hole collapse or some other undesired event.

The drilling assembly includes a number of control systems for controlling and optimising the drilling process. These include sensors maintaining drilling parameters TOB, WOB, RPM, ROP as well as operational and/or diagnostic parameters of the drilling assembly. These can be used to control the action of the crawler so as to avoid bit stalling, slipping anchors, or overloading of any of the parts of the system.

The crawler is preferably of the type described in PCT/EP04/01167 and includes anchors that, when extended and locked, provide a reaction point against both axial and torque forces arising from the drilling process. The crawler also includes a flow conduit through the mechanism so as to allow a flow of drilling fluid to and from the drill bit. The manner in which the flow of drilling fluid takes place is also described in PCT/EP04/01167.

What is claimed is:

1. A drilling system for use in a borehole through an underground formation, comprising:

a drilling assembly including a drill bit operable to drill through the formation and a drilling drive having an anchor mechanism for anchoring at least one end of the drilling drive in position in the borehole;

a conveyance drive connected to the drilling assembly and operable to move the drilling assembly through the borehole, wherein the conveyance drive is operable to move the drilling assembly along the borehole into a drilling position at a higher rate at which the drilling drive is operable to urge the drill bit into contact with the formation when drilling takes place in the drilling position, the conveyance drive and the drilling drive having both pushing and pulling functions.

2. The drilling system as claimed in claim 1, wherein the drilling drive is operable so as to control the weight applied to the drill bit during drilling.

3. The drilling system as claimed in claim 2, wherein the drill bit is rotated during drilling, the drilling drive being operable to avoid bit stalling.

4. The drilling system as claimed in claim 1, wherein the drill bit is rotated during drilling, the anchoring system anchoring the drilling assembly against rotation arising from torque generated by rotation of the drill bit.

5. The drilling system as claimed in claim 1, wherein the drilling drive further comprises a piston operable with the anchor mechanism to urge the drill bit into contact with the formation and to pull the drill bit back from contact with the formation.

6. The drilling system as claimed in claim 1, wherein the drilling drive further includes a flow conduit to allow drilling fluid to flow through the drilling drive.

7. The drilling system as claimed in claim 1, wherein the conveyance drive further comprises a wireline tractor and wireline cable extending from the conveyance drive through the borehole to the surface.

8. The drilling system as claimed in claim 1, wherein the conveyance drive further comprises a coiled tubing tractor and coiled tubing extending from the conveyance drive through the borehole to the surface.

9. The drilling system as claimed in claim 1, wherein the conveyance drive is operable to move the drilling assembly through portions of the borehole that are highly deviated from vertical.

* * * * *